US011278135B2

(12) United States Patent
Kuang et al.

(10) Patent No.: US 11,278,135 B2
(45) Date of Patent: Mar. 22, 2022

(54) CERVICAL ASSIST PILLOW

(71) Applicant: Tang Yong Kuang, Lucas, TX (US)

(72) Inventors: Tang Yong Kuang, Lucas, TX (US); Grace Tian-hui Kuang, Lucas, TX (US)

(73) Assignee: Tang Yong Kuang, Lucas, TX (US)

( * ) Notice: Subject to any disclaimer, the term of this patent is extended or adjusted under 35 U.S.C. 154(b) by 0 days.

(21) Appl. No.: 16/859,730

(22) Filed: Apr. 27, 2020

(65) Prior Publication Data

US 2021/0330103 A1 Oct. 28, 2021

(51) Int. Cl.
*A47G 9/10* (2006.01)
*A47C 20/02* (2006.01)

(52) U.S. Cl.
CPC ..... *A47G 9/1081* (2013.01); *A47C 20/027* (2013.01); *A47G 9/10* (2013.01); *A47G 9/1009* (2013.01); *A47G 2009/1018* (2013.01)

(58) Field of Classification Search
CPC ..... A47G 9/10; A47G 9/109; A47G 9/1009; A47G 2009/1018; A47G 9/1081; A47C 20/027
See application file for complete search history.

(56) References Cited

U.S. PATENT DOCUMENTS

| | | | | |
|---|---|---|---|---|
| 6,817,049 | B1 | 11/2004 | Hall | |
| 10,264,899 | B2 * | 4/2019 | Biebl | A47G 9/1081 |
| 2006/0236459 | A1 * | 10/2006 | Lavin | A47G 9/109 5/636 |
| 2008/0271249 | A1 * | 11/2008 | Deetsch | A47C 16/00 5/640 |

* cited by examiner

*Primary Examiner* — David R Hare
*Assistant Examiner* — Madison Emanski
(74) *Attorney, Agent, or Firm* — Timothy T. Wang; Ni, Wang & Massand, PLLC

(57) ABSTRACT

A cervical assist pillow, comprising, a lower back support portion having a wedge therein to accept a user's upper back and shoulders, an upper neck support portion adjacent the lower back support portion, the upper neck support portion having an extended height to support the users neck proximate a user's head and having a height to elevate the user's neck at a cervicomental angle between approximately 100 and 120 degree, a head support portion adjacent the upper neck support portion and having a concavity to accept the back of the user's head and a waist belt coupled to the lower back support portion at a first end and detachably coupleable to a user's midsection to prevent slippage from under the user's head and neck.

4 Claims, 6 Drawing Sheets

CERVICAL ASSIST PILLOW

BACKGROUND

Technical Field

The instant disclosure is related to a mechanism to insure an unobstructed airway during sleep on the back position and specifically a cervical assist pillow.

Background

The majority of the adult population snores at various intensities during sleep, those who snore louder may have obstructive sleep apnea (OSA) due to blockage of airflow from the collapsing of the upper airway. Based on the diagnostic criteria of apnea-hypopnea index (AHI)≥5 times/hour per the American Academy of Sleep Medicine (AASM) in 2012, an estimated 936 million people worldwide between the ages of 30 and 69 have OSA; among them an estimated 425 million people worldwide meet the requirement for moderate OSA with AHI≥15 times/hour that are usually recommended for treatment as it increases risk of cardiovascular comorbidities if left untreated.

At present, there is no easy treatment option for OSA. The most widely relied upon treatment method is to use continuous positive airway pressure treatment (CPAP) during sleep. Alternative treatment options include oral appliances, surgery and/or weight loss. CPAP and oral appliance treatment are uncomfortable, inconvenient, and have only a 50-60% compliance rate; especially when the CPAP pressure is high. When the CPAP pressure is high the mask is prone to air leaks and discomfort. There are multiple limitations related to a surgical treatment option, which include high cost, surgical risks and a relatively low effective cure rate of about 60%.

What is sought is another method of providing an unobstructed airway during sleep that does not rely upon a CPAP or surgery.

SUMMARY

An example cervical assist pillow, comprising at least one of, a lower back support portion having a wedge therein to accept a user's upper back and shoulders, an upper neck support portion adjacent the lower back support portion, the upper neck support portion having an extended height to support the users neck proximate a user's head and having a height to elevate the user's neck at a cervicomental angle between approximately 100 and 120 degree, a head support portion adjacent the upper neck support portion and having a concavity to accept the back of the user's head and a waist belt coupled to the lower back support portion at a first end and detachably couple-able to a user's midsection to prevent slippage from under the user's head and neck.

Another example cervical assist pillow insert, comprising at least one of, a lower rail portion connectable to a pillow at a lower end and a bulbous portion connected to the lower rail portion and having a combined height to elevate a user's neck at a cervicomental angle between approximately 100 and 120 degree.

and

Figure 6:
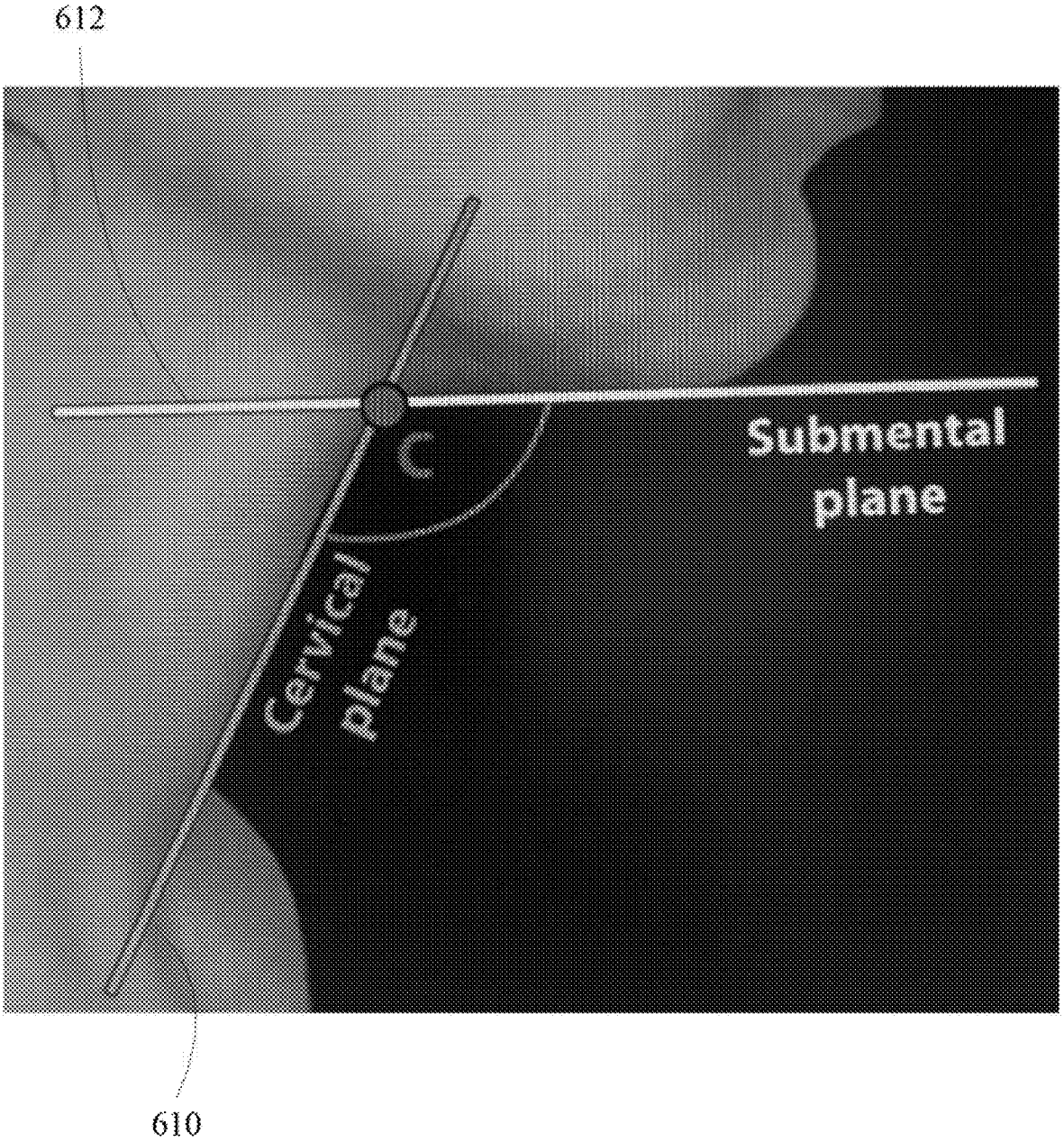

FIG. 6 depicts a cervicomental angle between the submental plane to the cervical plane.

DETAILED DESCRIPTION OF THE INVENTION

The embodiments listed below are written only to illustrate the applications of this apparatus and method, not to limit the scope. The equivalent form of modifications towards this apparatus and method shall be categorized as within the scope the claims.

Certain terms are used throughout the following description and claims to refer to particular system components. As one skilled in the art will appreciate, different companies may refer to a component and/or method by different names. This document does not intend to distinguish between components and/or methods that differ in name but not in function.

In the following discussion and in the claims, the terms "including" and "comprising" are used in an open-ended fashion, and thus may be interpreted to mean "including, but not limited to . . . ." Also, the term "couple" or "couples" is intended to mean either an indirect or direct connection. Thus, if a first device couples to a second device that connection may be through a direct connection or through an indirect connection via other devices and connections.

Snoring and OSA tend to be worse when people sleep on their back as airway tends to collapse more at this position, in fact there are subgroup of patients who have OSA only when they sleep on the back position. During cardiopulmonary resuscitation (CPR), the head is tilted to a chin-lit position to keep the upper airway passage open. Based on this observation, the cervical assist pillow supports of the neck and tilt of the head so that users can maintain a head-tilt chin-lift position during sleep to keep their upper airway open.

The device may keep the upper airway open more effectively, which may relieve snoring and obstructive sleep apnea when lying on the back position. If CPAP therapy is used simultaneously it can also help reduce the CPAP pressure requirement reduce discomfort and air leak at CPAP mask by avoiding CPAP mask compressing on the pillow so that CPAP treatment compliance can be improved.

The cervical assist pillow may more effectively support the neck and tilt of the head so that users may maintain head-tilt chin-lift position while sleeping on their back to keep their upper airway patent. The cervical assist pillow may be made from polyurethane or latex using foaming technology.

The cervical assist pillow waist belt at the pillowcase may prevent the head from sliding down toward the feet, and ensure the head remaining in tilt position while sits in the concave area of the pillow, so the upper airway would remain open when lying on the back position.

The cervical assist pillow insert may adjust the firmness and height of the pillow to provide comfortable and effective support for the neck based on individual preference. It may also be filled with incents, herbs or other material that may assist in helping a user sleep better.

Figure 1:
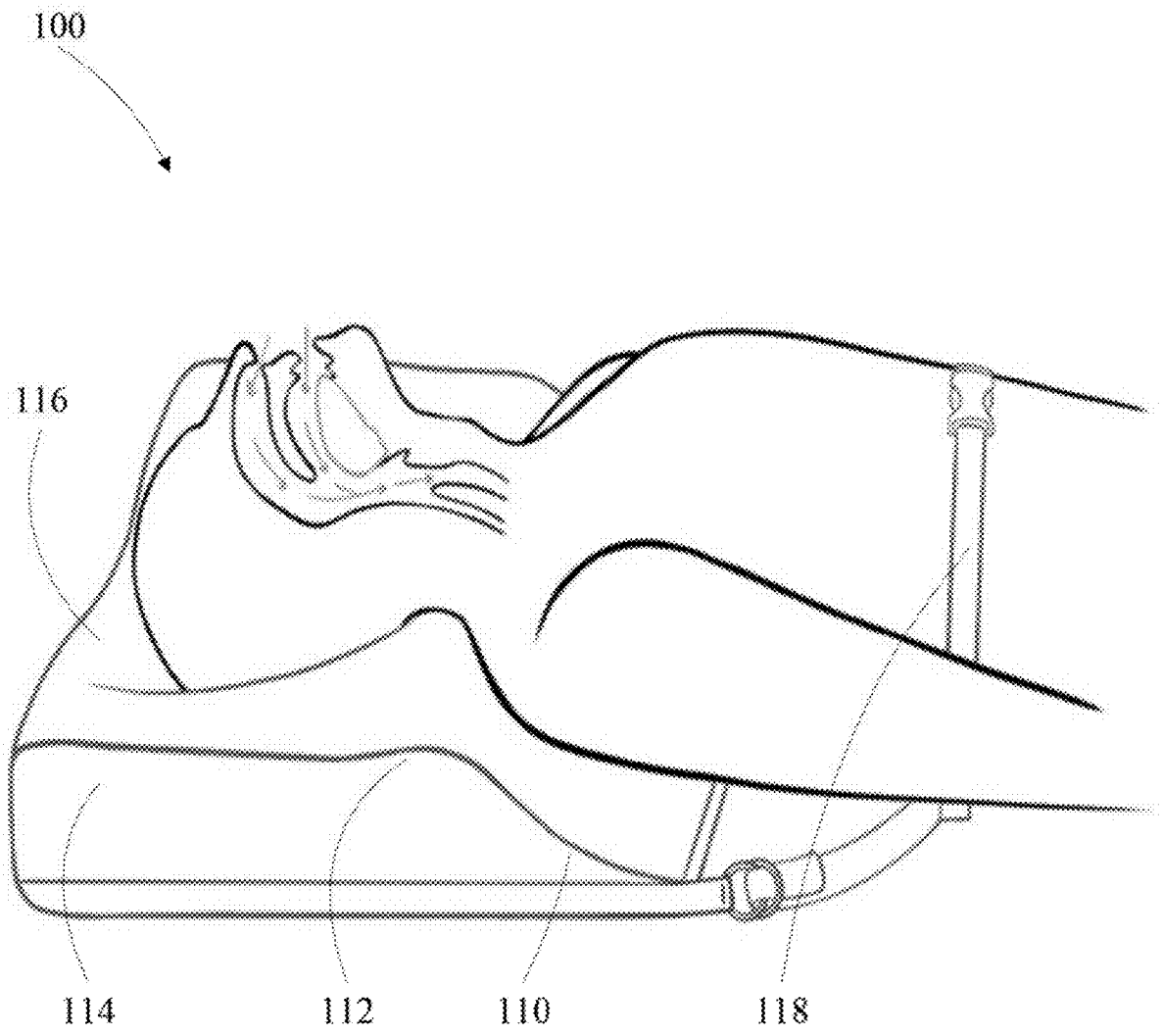
FIG. 1 is a first example cervical assist pillow.

FIG. 1 depicts an example adjustable assist pillow 100. The device depicts a lower back support portion 110 to accept a user's upper back and shoulders, and an upper neck support portion 112 adjacent the lower back support portion. The upper neck support portion may have an extended height to elevate the user's neck proximate a user's head and provide a height sufficient to provide support to the user's neck such that a cervicomental angle (shown in FIG. 6) is kept between approximately 100 and 120 degree. A head support portion 114 may be adjacent the upper neck support portion 112 and have a concavity 116 to accept the back of the user's head. A waist belt 118 may be coupled to the lower back support portion 10 at a first end and detachably couple-able to a user's midsection to prevent slippage from under the user's head and neck. The device may prevent the chin of the user from lowering toward the chest, resulting in an obstructed airway. The lower back support portion, the upper neck support portion and the head support portion may be formed of one piece into a unitary body. The lower back support portion, the upper neck support portion, the head support portion and the waist belt may be hypoallergenic.

Figure 2:
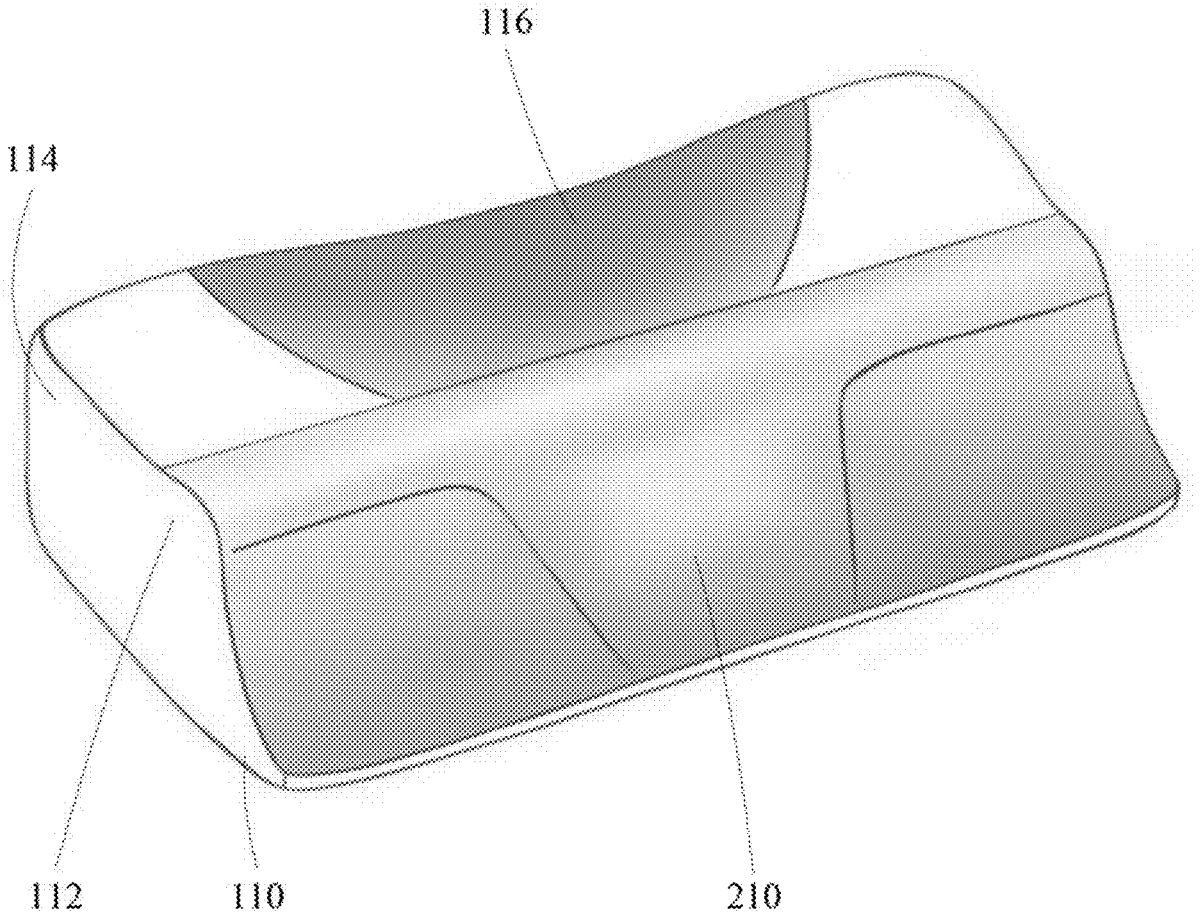
FIG. 2 is another example cervical assist pillow.

FIG. 2 depicts an example cervical assist pillow. The example cervical assist pillow includes a lower back support portion 110 having a wedge 210 therein to accept a user's upper back and shoulders. An upper neck support portion 112 is adjacent the lower back support portion 110, the upper neck support portion 112 having an extended height to support the users neck proximate a user's head. The upper neck support portion 112 has a height sufficient to elevate to the user's neck such that a cervicomental angle (shown in FIG. 6) is kept between approximately 100 and 120 degree. A head support portion 114 adjacent the upper neck support portion 112 and has a concavity 116 to accept the back of the user's head. The lower back support portion, the upper neck support portion and the head support portion may be formed of one piece into a unitary body.

Figure 3:
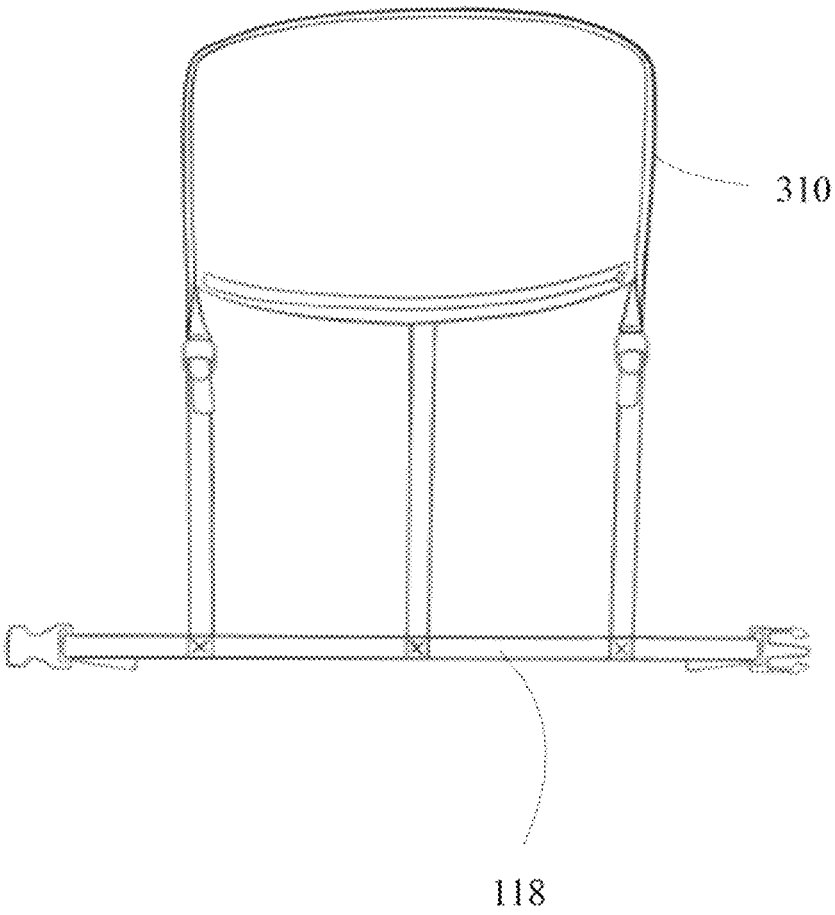
FIG. 3 is an example cervical assist pillow having a waist belt coupled to a pillow case surrounding the cervical assist pillow.

FIG. 3 depicts an example cervical assist pillow having a waist belt coupled to a pillow case surrounding the cervical assist pillow. In this example the cervical assist pillow is encased in a pillow case 310 and the waist belt 118 is coupled to the pillow case 310.

Figure 4:
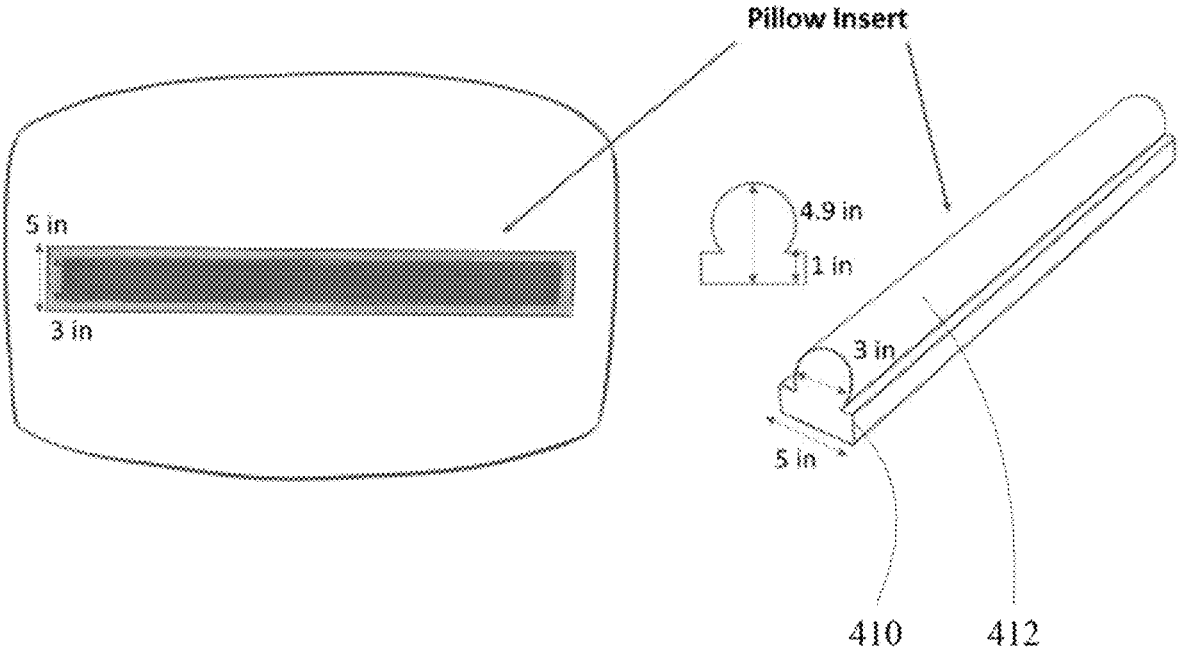
FIG. 4 depicts example cervical assist pillow insert in which the insert extends over a part of the top surface of a pillow.

FIG. 4 depicts an example cervical assist pillow insert in which the insert extends over a part of the top surface of a pillow. The cervical assist pillow insert includes a lower rail portion 410 connectable to a pillow at a lower end and a bulbous portion 412 connected to the lower rail portion and having a combined height to elevate a user's neck such that a cervicomental angle (FIG. 6) is between approximately 100 and 120 degree. The lower rail portion and the bulbous portion may be formed of one piece into a unitary body.

Figure 5:
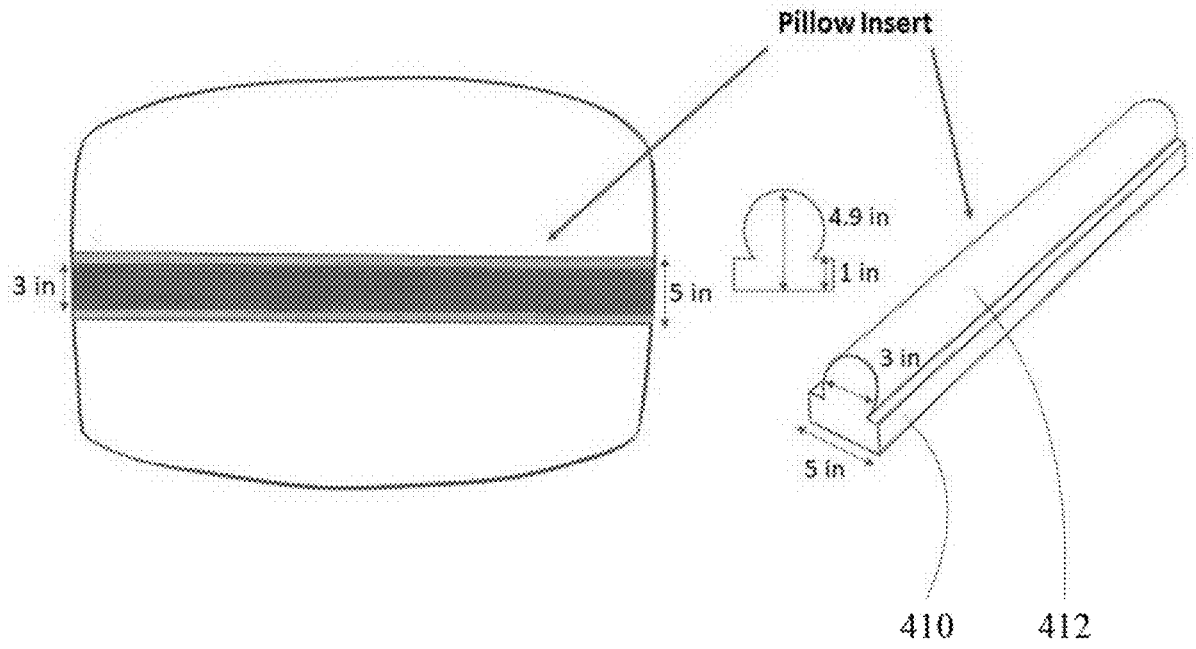
FIG. 5 depicts another example cervical assist pillow insert in which the insert extends over a top surface of a pillow.

FIG. 5 depicts another example cervical assist pillow insert in which the insert extends over a top surface of a pillow. The cervical assist pillow insert may include, a lower rail portion 410 connectable to a pillow at a lower end and a bulbous portion 412 connected to the lower rail portion and having a combined height to elevate a user's neck such that a cervicomental angle (FIG. 6) is between approximately 100 and 120 degree. The lower rail portion and the bulbous portion may be formed of one piece into a unitary body.

FIG. 6 depicts an example cervicomental angle between the cervical plane 610 and the submental plane 612 of a user. The adjustable cervical collar may approximate a cardiopulmonary resuscitation chin lift during use wherein the curved top board forms approximately 100 to approximately 120 degree angle with the two upper columns. This 100 to 120 degree angle may be the angle between the cervical plane 610 and the submental plane 612.

Those of skill in the art would appreciate that the various illustrative blocks, modules, elements, components, methods, and algorithms described herein may be implemented as electronic hardware, computer software, or combinations of both. To illustrate this interchangeability of hardware and software, various illustrative blocks, modules, elements, components, methods, and algorithms have been described above generally in terms of their functionality. Whether such functionality is implemented as hardware or software depends upon the particular application and design constraints imposed on the overall system. Skilled artisans may implement the described functionality in varying ways for each particular application. Various components and blocks may be arranged differently (e.g., arranged in a different order, or partitioned in a different way) all without departing from the scope of the subject technology.

The previous description is provided to enable any person skilled in the art to practice the various aspects described herein. The previous description provides various examples of the subject technology, and the subject technology is not limited to these examples. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention. The predicate words "configured to", "operable to", and "programmed to" do not imply any particular tangible or intangible modification of a subject, but, rather, are intended to be used interchangeably. For example, a processor configured to monitor and control an operation or a component may also mean the processor being programmed to monitor and control the operation or the processor being operable to monitor and control the operation. Likewise, a processor configured to execute code may be construed as a processor programmed to execute code or operable to execute code.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such as an "embodiment" may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such as a "configuration" may refer to one or more configurations and vice versa.

The word "example" is used herein to mean "serving as an example or illustration." Any aspect or design described herein as "example" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

References to "one embodiment," "an embodiment." "some embodiments," "various embodiments", or the like indicate that a particular element or characteristic is included in at least one embodiment of the invention. Although the phrases may appear in various places, the phrases do not necessarily refer to the same embodiment. In conjunction with the present disclosure, those skilled in the art will be able to design and incorporate any one of the variety of mechanisms suitable for accomplishing the above described functionalities.

It is to be understood that the disclosure teaches just one example of the illustrative embodiment and that many variations of the invention can easily be devised by those skilled in the art after reading this disclosure and that the scope of then present invention is to be determined by the following claims.

What is claimed is:

1. A cervical assist pillow, comprising:

a lower back support portion having a wedge therein capable to accept and support a user's upper back and shoulders;

an upper neck support portion adjacent to the lower back support portion, the upper neck support portion having an extended height capable to accept and support a user's neck proximate a user's head and having an adjustable height to elevate the user's neck to achieve a cervicomental angle between 100 and 120 degrees to reduce sleep apnea due to upper airway obstructions when the user sleeps facing up in a supine position;

a head support portion adjacent the upper neck support portion and having a concavity centrally located in the head support portion capable to accept and support the back of the user's head when the user sleeps in the pine position and two flat facial support portions positioned on either side of the concavity; and a waist belt coupled to a strap, the strap extending around a pillow case covering, the waist belt coupled to the strap at a lower back support portion of the cervical assist pillow at a first end and the waist belt detachably couple-able to a user's waist to prevent the user from sliding down caudally from the cervical assist pillow and maintain the cervicomental angle, wherein the waist belt is coupled to the strap at a location below and beside the user during use.

2. The cervical assist pillow of claim 1, wherein the lower back support portion, the upper neck support portion and the head support portion form a unitary body.

3. A cervical assist pillow, comprising:

a lower back support portion having a wedge therein capable to accept and support a user's upper back and shoulders;

an upper neck support portion adjacent to the lower back support portion, the upper neck support portion having an extended height capable to accept and support a user's neck proximate a user's head and having an adjustable height to elevate the user's neck to achieve a cervicomental angle between 100 and 120 degrees to reduce sleep apnea due to upper airway obstructions when the user sleeps facing up in a supine position;

a head support portion adjacent the upper neck support portion and having a concavity centrally located in the head support portion capable to accept and support the back of the user's head when the user sleeps in the supine position and two flat facial support portions positioned on either side of the concavity;

a waist belt coupled to a strap, the strap extending around a pillowcase covering, the waist belt coupled to the strap at a lower back support portion of the cervical assist pillow at a first end and the waist belt detachably couple-able to a user's waist to prevent the user from sliding down caudally from the cervical assist pillow and maintain the cervicomental angle, wherein the waist belt is coupled to the strap at a location below and beside the user during use; and a cervical assist pillow insert having a lower rail portion connectable to the cervical assist pillow at a lower end and a bulbous portion connected to the lower rail portion and having a combined height to elevate a user's neck at a cervicomental angle between 100 and 120 degrees.

4. The cervical assist pillow insert of claim 3, wherein the lower rail portion and the bulbous portion form a unitary body.

* * * * *